United States Patent [19]

Cser

[11] 4,064,696

[45] Dec. 27, 1977

[54] LIVE-GAS CONDUIT SYSTEM FOR TURBOCHARGED SIX-CYLINDER ENGINES

[75] Inventor: Gyula Cser, Budapest, Hungary

[73] Assignee: Autoipari Kutato Intezet, Budapest, Hungary

[21] Appl. No.: 685,366

[22] Filed: May 11, 1976

[30] Foreign Application Priority Data

May 13, 1975 Hungary ..... CE 339

[51] Int. Cl.² ..... F02B 37/04

[52] U.S. Cl. ..... 60/598; 123/52 M

[58] Field of Search ..... 60/598, 605, 611; 123/52 M

[56] References Cited

U.S. PATENT DOCUMENTS

| | | | |
|---|---|---|---|
| 2,390,913 | 12/1945 | Barrett | 123/52 M |
| 2,581,668 | 1/1952 | Kadenacy | 60/605 |
| 2,740,389 | 4/1956 | Reyl | 123/52 M |
| 3,796,048 | 3/1974 | Annus et al. | 60/598 |
| 3,845,746 | 11/1974 | Elsbett | 123/52 M |

*Primary Examiner*—C. J. Husar

*Assistant Examiner*—L. J. Casaregola

[57] ABSTRACT

Live-gas conduit system for turbocharged, six-cylinder, serially connected internal-combustion engines, linked between the suction inlets of the cylinders and the turbocharger, comprising two separate resonance tanks, each attached to the suction inlets of three adjoining engine cylinders, a resonance tube for each resonance tank, and a damping tank that links the inlet openings of the resonance tubes with the pressure side of the turbocharger. Special proportions and placements are suggested to attain a space-saving arrangement that reduces the space requirement, and particularly the length, of the conduit system.

9 Claims, 5 Drawing Figures

LIVE-GAS CONDUIT SYSTEM FOR TURBOCHARGED SIX-CYLINDER ENGINES

Figure 1:
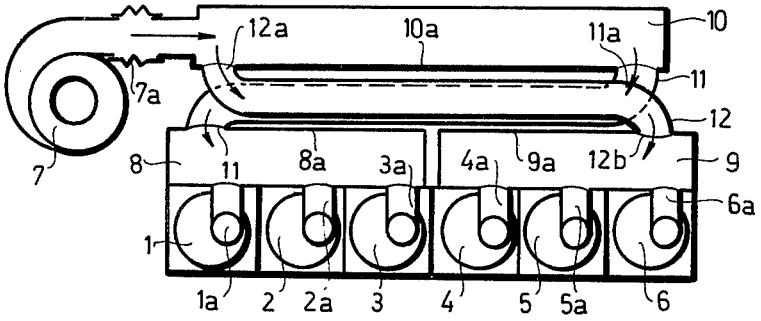

The invention relates to a multi-space live-gas conduit system for a turbocharged, six-cylinder, serially arranged internal-combustion piston engine, linked between the suction inlets of the cylinders and the turbocharger.

The performance of internal-combustion piston engines can be considerably increased if the live gas fills the cylinder space of the engine not only as a result of the suction of the cylinders but on effect of an externally driven compressor. It is understood that "live gas" denotes the air required for combustion in case of engines that have an internal mixture formation, while it denotes the mixture of fuel and air in case of external mixture formation. Nowadays usually turbochargers are used as compressors, that are driven by the exhaust gases of the engine, owing to the numerous operational and constructional advantages thereof.

A process became known which further increases the efficiency of turbocharging, expands its earlier advantageous qualities, and thus broadens its field of application. In the first range of the operational speed domain of the engine, where the charging efficiency of the turbocharger is not yet satisfactory, this procedure uses dynamic/resonant/charging for supplementing the turbocharging, and for increasing live charge of the cylinder, the charging being produced by the favorably tuned oscillations of the live gas. The maximum moment of a turbocharger engine operating according to such a principle can be 20 to 30% higher than that of the conventional turbocharger engines, and furthermore the maximum moment can be achieved at a substantially lower engine speed. Thus the moment resiliency of the engine is more favorable, and the air pollution/Diesel smoking/is reduced that occurs with lower speeds and with sudden acceleration.

For purposes of the favorable tuning of the live-gas oscillations, that is for accomplishing the resonant charging, the engine has an arrangement - namely a live-gas conduit system that is connected between the suction inlets of the engine and the turbocharger, and which consists of tanks linked to the suction inlets - namely resonance tanks -, of respectively attached tubes - namely resonance tubes -, and of a damping tank that links the resonance tubes with the turbocharger.

Resonance tanks can be connected to each cylinder of the engine, but a solution is also known where the suction inlets of those cylinders, of which the suction periods do not substantially overlap, are connected onto a common resonance tank, that is of maximally four engine cylinders. In these respects the six-cylinder series-disposed engine offers favorable possibilities, having the customary ignition sequence of 1-5-3-6-2-4. The increasing sequence of the numbering denotes the numbers of the cylinders. It is to be noted that the opening periods of the suction inlets do not practically overlap within the two groups of adjoining cylinders in the mentioned engine, consisting of the cylinders 1., 2. and 3., as well as 4., 5. and 6. Thus the suction inlets of the adjoining cylinders of the groups can advantageously be connected onto a common resonance tank each, each with a resonance tube being attached thereto. The damping tank consequently links only two resonance tubes to the turbocharger.

The live gas is delivered to the conduit by the compressor of the turbocharger. The intermittent suction effect of the engine cylinders of each resonance tank causes periodic pressure fluctuations in the resonance tank, which excites the gas column to oscillations, which column flows in the resonance tube attached to the resonance tank.

If the number of suction periods coincides with the self-oscillations of the acoustic system constituted by the gas flowing in the resonance tank and tube, the system takes up oscillations and, as an end result, the dynamic/resonant/charging takes effect owing to the increased pressure oscillations, which charging supplements the turbocharging. In this case the positive pressure waves of the pressure oscillations, increased by the resonance, are formed in the resonance tank just before the moment of closing the suction inlet.

Thus the live gas is forced into the engine cylinder on account of the momentary pressure wave being superimposed on the pressure of the turbocharger. Resonant charging thus offers the highest charging effect at an engine speed where resonance is formed, which speed is therefore also termed the resonance speed. At the same time it is also known that, if the volume of the resonance tank and the length of the resonance tube is advantageously selected, resonance charging will be effective not only at the resonance speed or in its neighborhood but over the entire operational speed range, namely if the volume of the resonance tank is larger than half of the stroke volume of the connecting cylinders, but smaller than its tenfold, and/or if the length of the resonance tube is more than the eightfold of the diameter of a circle having the cross-section of the resonance tube.

The highest charging effect is achieved also in this case at the resonance speed, but charging diminishes only gradually, without a sudden transition, as we get farther away - in the direction of both lower and higher revolutions. Thus the resonance charging induced in a live-gas conduit system that has therein properly dimensioned elements favorably complements turbocharging as well as the live-gas requirement of the engine not only at the nominal speed and the resonance speeds but within the entire operational domain of revolutions. This makes it possible to attain a curve of the moment that has a high resiliency and a favorable course.

While displaying the enumerated advantages the mentioned charging procedure has the disadvantageous quality that the live-gas conduit system required for its attainment, consisting of resonance tanks with predetermined volumes, and/or of resonance tubes with predetermined lengths, and of a damping tank, necessitate substantial space next to the engine.

If for example the circular cross-section resonance tubes have a diameter of 70 mm, the tube length that is eight times that of the diameter amounts to 560 mm. Considering the corresponding dimensions of the resonance tanks and of the damping tank, encasing measurements may result for the live-gas conduit system that exceed the width or height measurements of the engine. The resonance tubes are naturally not necessarily of a perpendicular arrangement to the longitudinal axis of the engine, they can also be oblique by comparison.

In this case the width measurement can be reduced but the tubes that are led angularly forward or rearward next to the engine necessarily increase the length measurement of the engine as well.

All these present difficulties in respect of the building of the engine into a vehicle, and in some cases even make this impossible. This of course makes the possibility questionable of practically adopting the procedure that has the mentioned advantages.

For this reason it is the object of the invention to do away with the installing difficulties caused by the cumbersome character of the previous live-gas conduit system of the turbocharged six-cylinder series engine, and to provide a live-gas conduit system which does not increase the installation space requirement of the engine and thus insures a favorable possibility for its practical use.

The invention is a multi-space live-gas conduit system for a turbocharged, six-cylinder, serially arranged internal-combustion piston engine, linked between the suction inlets of the cylinders and the turbocharger, which conduit system has two separate resonance tanks, each attached to the suction inlets of three adjoining cylinders, with a volume larger than half of the stroke volume of the connecting cylinders but smaller than its tenfold, a resonance tube for each resonance tank, adjoining with its outlet opening, the length of which is at least eight times that of the diameter of a circle having the cross-section of the tube, and finally a damping tank that links the inlet openings of the resonance tubes with the pressure side of the turbocharger.

The invention consists in that the characteristic longitudinal extensions of the resonance tanks, of a damping tank, and of the resonance tubes that interconnect the resonance tanks with the damping tank, being successively disposed along the longitudinal axis of the engine, have all the same direction, and that the resonance tubes open into the resonance tank that is farther away from their inlet openings.

The live-gas conduit system can be applied advantageously with an exemplary embodiment wherein the damping tank has in its longitudinal extension a common wall with the resonance tanks. In this case the resonance tubes are preferably arranged within the damping tank but they can also be placed in the resonance tanks.

A further embodiment of the inventive conduit system has one of the walls of the resonance tank and of the damping tank formed in the longitudinal extension as a respective wall of the resonance tubes.

The invention is described in detail in its practical embodiments in FIGS. 1 to 5, wherein FIG. 1 is a longitudinal cross-sectional view of the live-gas conduit system according to the invention, mounted on a six-cylinder series-type engine; and FIGS. 2 to 5 show further exemplary embodiments in illustrations similar to that of FIG. 1.

A six-cylinder series-type internal-combustion piston engine has cylinders 1 to 6 with suction inlets 1*a* to 6*a*, a turbocharger 7 with a pressure side 7*a*, the live-gas inventive conduit system being connected between the suction inlets and the pressure side, namely with its resonance tank 8 to the suction inlets 1*a* to 3*a*, and with its resonance tank 9 to the suction inlets 4*a* to 6*a*. Thus the cylinders 1–3 take in the live gas during their suction periods from the resonance tank 8 and the cylinders 4–6 from the resonance tank 9. The volumes of the resonance tanks are larger than half of the stroke volume of the connecting cylinders but smaller than the tenfold value.

The resonance tanks 8 and 9 are connected with a damping tank 10 by means of resonance tubes 11 and 12, the length of their center line being at least eight times larger than the diameter of a circle having an identical cross-section. Inlet openings 11*a* and 12*a* of the resonance tubes are connected to the damping tank 10 while an outlet opening 11*b* of the resonance tube 11 connects to the resonance tank 8, and an outlet opening 12*b* of the resonance tube 12 to the resonance tank 9.

The damping tank 10 is linked to the pressure side 7*a* of the turbocharger 7. This is possible with a direct connection but also by way of an intermediate tube (not shown).

The tanks 8, 9 and 10 are not necessarily limited by planar surfaces, such as the axial lines of the resonance tubes 11, 12 can also be any desired space curve. The characteristics longitudinal extension of the tanks is understood to define the maximum longitudinal extension of the space delimited by them, while the characteristic longitudinal extension of the resonance tubes define the maximum lengthwise extension of the space area occupied by them.

The characteristic longitudinal extension of the resonance tanks 8 and 9, disposed successively along the longitudinal axis of the engine, coincides according to the practical example with the direction of the axial line of the engine. The damping tank 10 as well as the characteristic longitudinal extension of the resonance tubes 11 and 12 also fall in the same direction. Thus all three thanks and the resonance tubes have characteristic longitudinal extensions that are substantially parallel with the longitudinal axis of the engine, and they use the space that is available along the long sides of the engine.

In order that the resonance tubes, which have longitudinal extensions substantially parallel with the longitudinal axis of the engine, and prescribed lengths, do not exceed the engine length, that is to avoid that they hang over the front or rear faces of the engine, the resonance tubes 11 and 12 are so arranged that they open into the resonance tank that is farther away from their inlet openings.

Thus the inlet opening 11*a* of the resonance tube 11 is connected to the damping tank 10 on the side of the resonance tank 9, but the outlet opening 11*b* opens into the resonance tank 8 which is farther away from the inlet opening 11*a*. The resonance tube 12 is similarly arranged, having its outlet opening 12*b* connected to the resonance tank 9 which is farther away from the inlet opening 12*a*.

Such an arrangement of the resonance tubes allows the entire extent of the live-gas conduit system to be utilized for the placement of the tubes, and at the place available at the side of the engine resonance tubes of the desired length can be arranged so that they do not essentially exceed the enclosing measurements of the system. By this the live-gas conduit system can be constructed in a most compact manner which allows the engine equipped with the given system to be built into a vehicle, consequently creating the favorable conditions of practical application.

Figure 2:
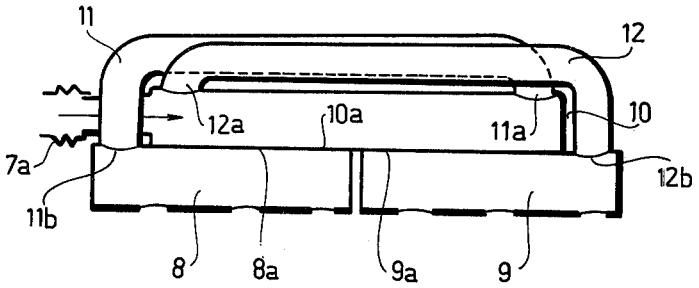

In FIG. 2 we can see a further favorable embodiment of the described system. For the sake of clarity, the cylinders have been omitted from FIGS. 2 to 5.

Here walls 8*a* and 9*a* of the resonance tanks 8 and 9, which are opposite the suction inlets of the cylinders, and a wall 10*a* of the damping tank 10, towards the resonance tanks, is made into a common partition wall. In this manner the three tanks constitute a single common unit, the space area occupied by them can be even better exploited for purposes of tank volume, and furthermore manufacturing advantages as well as weight decrease can be attained with the formation of the common wall.

Figure 3:
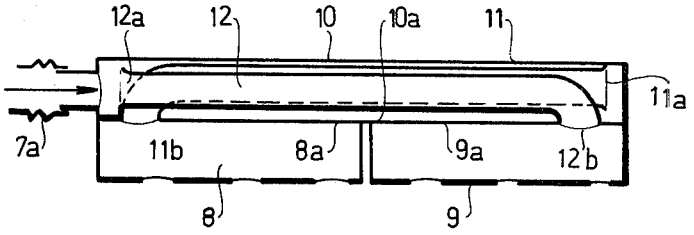

In FIG. 3 we see a further advantageous embodiment where the resonance tubes 11 and 12 are accommodated, in the longitudinal extension, within the damping tank 10, that has a common wall with the resonance tanks 8 and 9. With this solution the space area occupied by the tanks is fully utilizable for purposes of tank volume and for placing the resonance tubes. A further advantage results in that the live-gas conduit system according to the practical embodiment can be made as a single compact unit.

Figure 4:
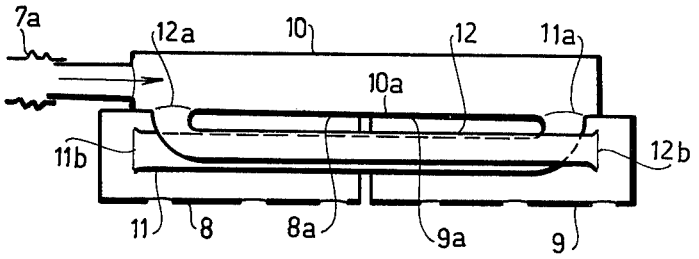

The embodiment illustrated in FIG. 4 has similar advantages but here the resonance tubes 11 and 12 are disposed in the resonance tanks.

Figure 5:
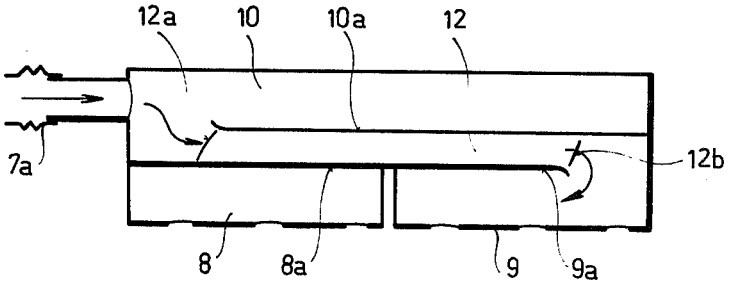

The example shown in FIG. 5 has the walls 8*a* and 9*a* of the resonance tanks 8 and 9, and the wall 10*a* of the damping tank 10, made to constitute respective walls of the resonance tubes arranged between them. Only tube 12 is shown while the other tube (11 in the preceding figures) can be arranged hidden, in an area behind that occupied by tube 12. The solution shown in the example similarly utilizes to a full extent the occupied space area, and creates favorable installation possibilities for the system.

The advantages exemplified in the embodiments can of course also be attained if the live-gas conduit system is arranged alongside the engine in a manner different from the plane illustrated in the drawings.

I claim:

1. A multi-space live-gas conduit system for six-cylinder, serially arranged internal-combustion piston engines, said cylinders having suction inlets, and including a turbocharger associated with said cylinders; the system being linked between said suction inlets and said tubrocharger, and comprising: two separate resonance tanks, each attached to said suction inlets of three adjoining cylinders, said tanks having a volume larger than half of the stroke volume of said three cylinders but smaller than the tenfold thereof; a resonance tube for each tank, adjoining outlet openings of the latter, and having lengths of their center lines which are at least eight times that of the diameter of a circle having the cross-section of said tubes; and a damping tank that links inlet openings of said tubes with the pressure side of said turbocharger; said tubes respectively interconnecting said resonance tanks with said damping tank; said tanks and said tubes being all successively disposed along the longitudinal axis of the engine; wherein the characteristic longitudinal extensions of said tanks and of said tubes all have the same direction; and further comprising a connection from each resonance tube that opens into one of said resonance tanks that is farther away from the respective inlet opening of said tube.

2. The conduit system as defined in claim 1, wherein said damping tank has in its longitudinal extension a common wall with at least one of said resonance tanks.

3. The conduit system as defined in claim 1, wherein said resonance tubes are arranged at least partly within said damping tank.

4. The conduit system as defined in claim 1, wherein said resonance tubes are arranged at least partly within said resonance tanks.

5. The conduit system as defined in claim 1, wherein one of the walls of each resonance tank and of said damping tank are formed in the longitudinal extension as a respective wall of said resonance tubes.

6. The conduit system as defined in claim 3, wherein said damping tank has in its longitudinal extension a common wall with at least one of said resonance tanks.

7. The conduit system as defined in claim 3, wherein one of the walls of each resonance tanks and of said damping tank are formed in the longitudinal extension as a respective wall of said resonance tubes.

8. The conduit system as defined in claim 4, wherein said damping tank has in its longitudinal extension a common wall with at least one of said resonance tanks.

9. The conduit system as defined in claim 4, wherein one of the walls of each resonance tank and of said damping tank are formed in the longitudinal extension as a respective wall of said resonance tubes.

* * * * *